United States Patent [19]

Sagaser et al.

[11] 4,279,566

[45] Jul. 21, 1981

[54] BACKHOE FRAME WEDGE MOUNT

[75] Inventors: Thomas M. Sagaser, Gwinner; Joseph M. Mather, Lisbon, both of N. Dak.

[73] Assignee: Clark Equipment Company, Buchanan, Mich.

[21] Appl. No.: 74,229

[22] Filed: Sep. 10, 1979

[51] Int. Cl.[3] ..... E02F 3/72

[52] U.S. Cl. ..... 414/686; 172/275; 292/266; 292/269; 403/100; 403/325; 403/327; 414/694

[58] Field of Search ..... 172/272, 273, 274, 275; 280/456 R, 456 A, 460 R, 460 A, 504, 507, 760; 292/266, 269; 403/100, 101, 102, 325, 327; 414/607, 685, 686, 687, 694, 723

[56] References Cited

U.S. PATENT DOCUMENTS

| | | | |
|---|---|---|---|
| 2,846,094 | 8/1958 | Pilch | 414/686 |
| 2,878,598 | 3/1959 | Pilch | 37/117.5 |
| 3,081,891 | 3/1963 | Przybylski | 414/694 |
| 3,220,487 | 11/1965 | Pilch | 172/274 |
| 3,672,521 | 6/1972 | Bauer et al. | 414/723 |
| 3,805,980 | 4/1974 | Kisaka | 414/686 |
| 3,984,016 | 10/1976 | Kuhn | 414/686 |
| 4,043,470 | 8/1977 | Pilch | 414/686 |
| 4,087,009 | 5/1978 | Profenna et al. | 414/686 |
| 4,111,319 | 9/1978 | Matsuyoshi et al. | 414/686 |
| 4,117,944 | 10/1978 | Beckstrom et al. | 414/724 |

*Primary Examiner*—Frank E. Werner
*Attorney, Agent, or Firm*—Mack L. Thomas

[57] ABSTRACT

A pair of connection devices serve as the upper connection between a traction vehicle such as a skid steer loader and an accessory apparatus such as a backhoe. Each connection device includes an anchor element including an anchor element outer end extending from the traction vehicle towards the accessory apparatus and a channel element including a channel element outer end extending from the traction vehicle and towards the accessory apparatus. The anchor element outer end and the channel element outer end have a selectively engaged position for connecting the accessory apparatus to the traction vehicle. A sleeve member is slidably disposed over and operatively connected to the channel element for movement thereon. The sleeve member has a surface adapted for selective locking contact with at least one of the outer element ends for retaining the element ends in an engaged position.

10 Claims, 4 Drawing Figures

BACKHOE FRAME WEDGE MOUNT

BACKGROUND OF THE INVENTION

1. Field of the Invention

This invention relates to connection devices between an accessory apparatus and traction vehicles and specifically to a connection device which is both quickly and easily engaged and disengaged and provides a wedging action between engaging elements that extend from the accessory apparatus and traction vehicle respectively, to insure a continuous tight engagement.

2. Description of the Prior Art

It is often desirable to attach accessory apparatus such as backhoes to traction vehicles such as skid steer loaders. Included in the prior art are various types of attachment devices which can be selectively spring biased to insure a continuous connection. Such devices have been of the quick attachment-quick disconnect type which can be controlled by the operator of the traction vehicle without leaving the operator's position in the traction vehicle or without leaving the operator's position in the accessory apparatus. However, forces acting on the traction vehicle or accessory apparatus sometimes are sufficient to overcome the spring bias applied to prior art attachment devices and cause undesired detachment. Prior art attachment devices less susceptible to detaching forces are of complicated structure and are time consuming to attach and disconnect.

SUMMARY OF THE INVENTION

The present invention solves the previously mentioned problems by employing a pair of wedging contact connection devices that are also of the quick attachment-quick disconnect type to serve as the upper connection between a traction vehicle and an accessory apparatus such as a backhoe. Each connection device includes a sleeve member slidably disposed over a channel element that extends from the backhoe towards the traction vehicle. An anchor element extends from the traction vehicle towards the backhoe and is rigidly fixed to the traction vehicle. The sleeve member is controlled by a handle connected thereto. The operator of the traction vehicle can control the handle from his operator's seat in the traction vehicle. The channel member has a generally rectangular downwardly open configuration having a downwardly directed opening in opposed vertical sidewalls of the outer end of the channel member. The openings in the channel member receive transversely opposed cylindrical bars extending from the outer end of the anchor element. The sleeve member is mounted for longitudinal movement in opposed elongated slots in respective sidewalls of the channel element by a bolt. The sleeve member is pivotable about the bolt.

Locking surfaces are provided on the edges of opposed vertical sidewalls of the sleeve member adjacent the outer element end of the channel element which lock the cylindrical bars of the anchor element into engagement with the downwardly disposed openings in the vertical sidewalls of the channel element. A spring acting between the rod and the channel member biases the locking surfaces of the sleeve member towards the outer end of the channel element. The sleeve member can be moved to a hook or static portion in the elongated slots which is spaced from the outer element end of the channel element.

A machine bolt upwardly extends from the outer surface of the base of the channel member and serves as a projection which abuts a leading edge of the base of the sleeve member when the connection device is in its disconnect position. The operator can pivot the sleeve member away from the channel element and above the projection by appropriate movement of the handle. In the above-described pivoted position, the sleeve member may be longitudinally moved toward the outer end of the channel element and so positioned may be downwardly pivoted to the engaged position of the connection device where the sleeve member overlies the channel element and where an elongated slot opening is provided in the base of the sleeve member to receive the projection. Sleeve member movement away from the engaged element ends is limited by projection-sleeve member slot contact and controlled by the length of the elongated slot in the base of the sleeve member when the connection device is in its engaged position. The sleeve member locking surfaces will stay in locking contact with the transverse cylindrical bars until the operator manually removes the sleeve member from such locking contact position by pivoting the sleeve member away from the channel element projection and longitudinally moving the sleeve member away from the projection.

Further features and advantages of the invention will become more readily understood by persons skilled in the art upon a perusal of the detailed description in conjunction with the attached drawings.

DETAILED DESCRIPTION OF THE PREFERRED EMBODIMENT

Figure 1:
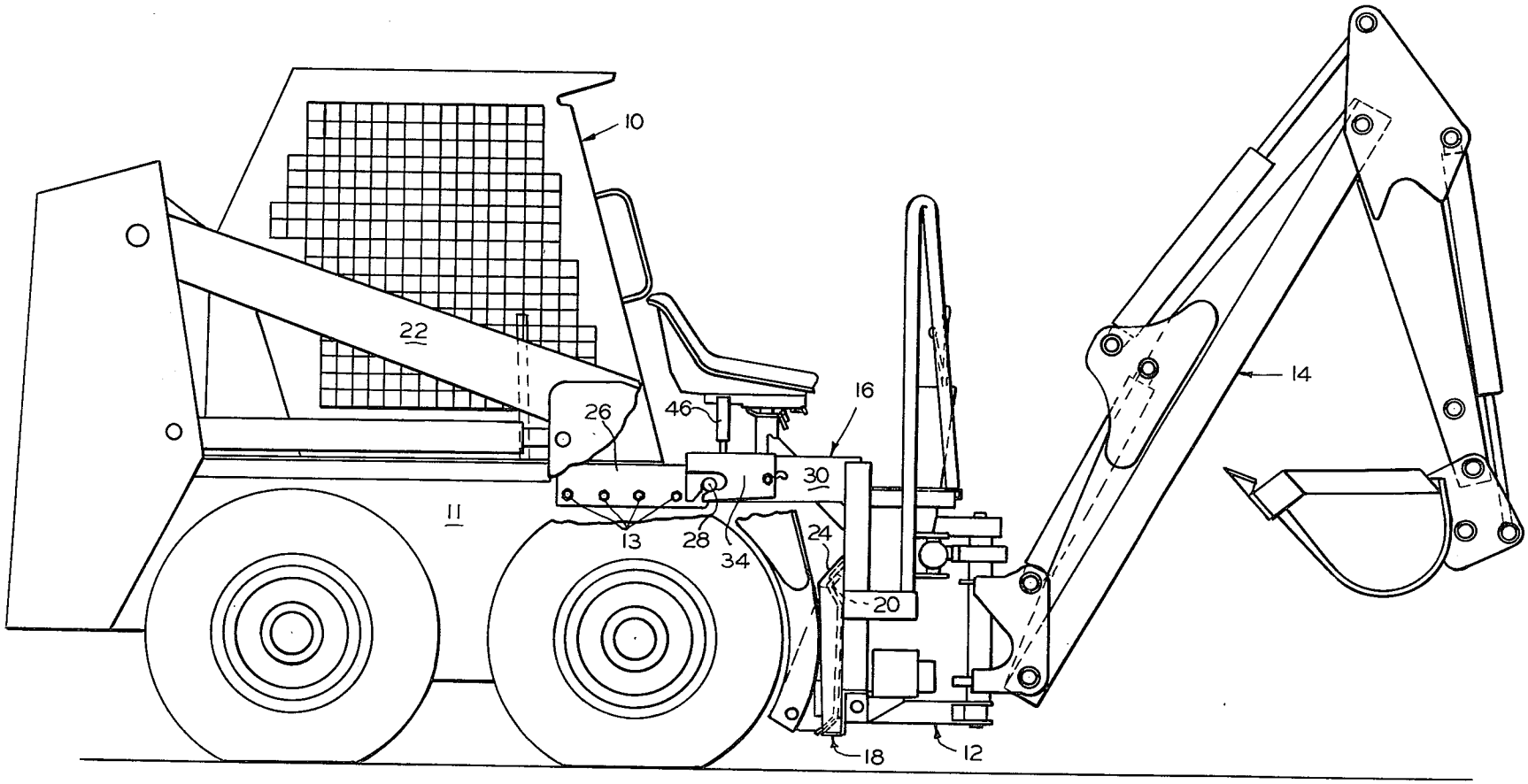
FIG. 1 is an elevational view of a skid steer loader connected with a backhoe frame by two upper connection devices embodying the present invention.

Referring initially to FIG. 1, a traction vehicle (specifically a skid steer loader 10) is connected to the mounting frame 12 of accessory apparatus (specifically a backhoe 14) by two spaced apart connection devices 16 and an adapter assembly 18. The loader, backhoe, and backhoe frame are all of a conventional type. The adapter assembly 18 is described in detail in U.S. Pat. No. 3,672,521 to Bauer et al (assigned to the Assignee of the present invention) and includes an elongate member 20 extending between spaced apart boom arms 22 and in wedging engagement with an overhanging member 24 attached to the rearward portion of the mounting frame 12 of the backhoe 14. The adapter assembly connection between the backhoe frame and the loader provides a lower load bearing connection between the backhoe mounting frame and loader.

As shown in FIGS. 1–4, the connection devices 16 provide a dual upper connection between the loader 10 and the backhoe 14. Each of the two spaced apart opposed connection devices 16 includes a first anchor element 26 fixed to the outer surface of the outer longitudinal main frame 11 of the skid steer loader 10 by bolt and nut assemblies 13. Alternatively the anchor elements 26 could be fixed to the inside surface of the longitudinal main frame 11 in the operator compartment. Each anchor element 26 extends from the loader toward the backhoe frame and a pair of transverse members or cylindrical bars 28 transversely extend in opposed directions at each outer end 27 of each anchor element 26. Spaced apart second channel elements 30 are attached to the mounting frame 12 of the backhoe 14 and extend from the backhoe towards the loader 10. Each channel element 30 is of generally rectangular configuration with an open bottom, a pair of spaced apart opposed vertical sidewalls 33 and a connecting base 56. Each sidewall 33 of channel element 30 has a downwardly disposed opening 32 at its outer end 31 for receiving a cylindrical bar 28.

Figure 2:
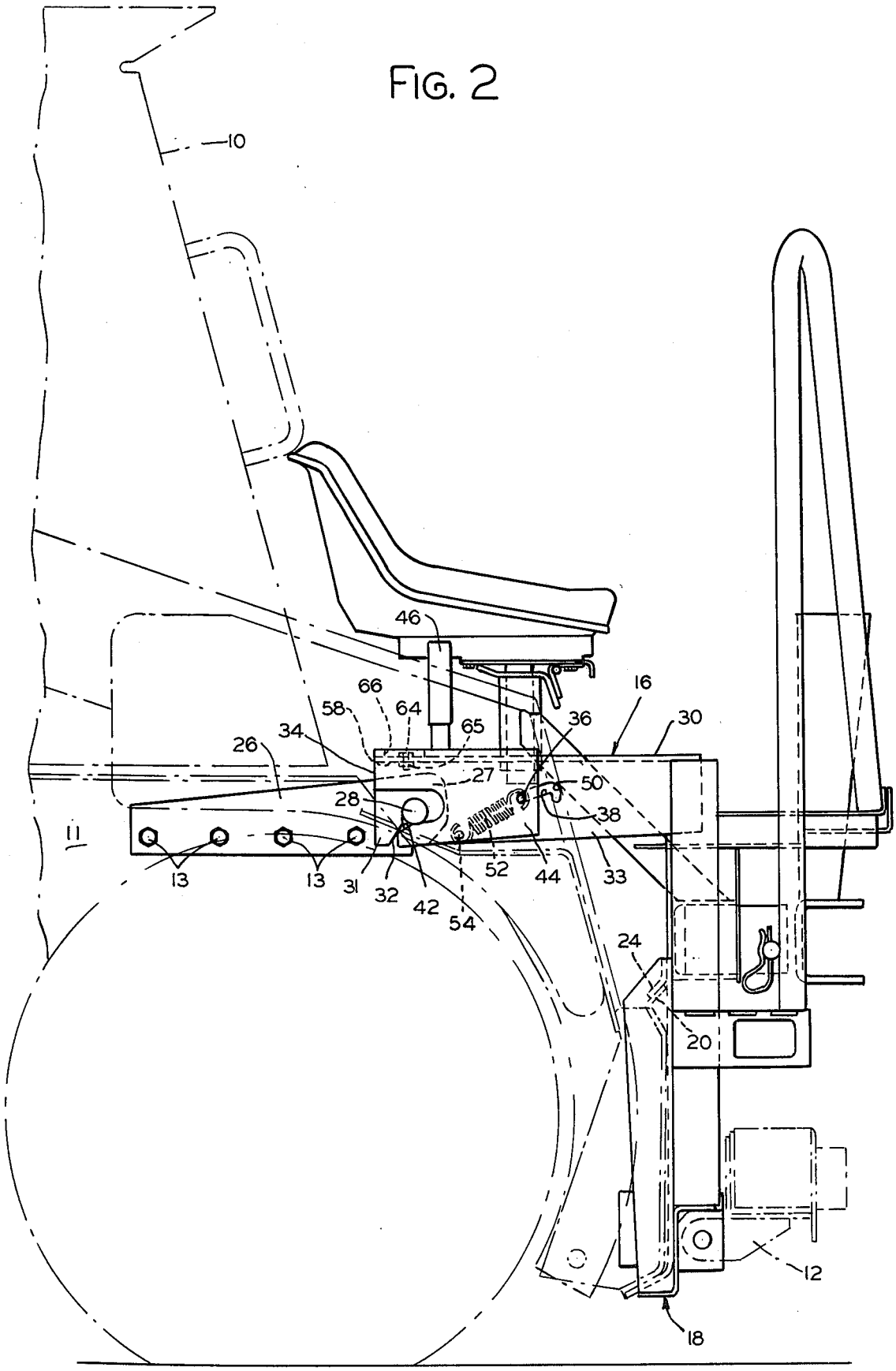
FIG. 2 is a detail elevational view of the connection device shown in FIG. 1 with the outwardly extending ends of the anchor and the channel elements of the present invention shown in their engaged position with the sleeve member mounted on the channel element shown in its locking contact position.
Figure 3:
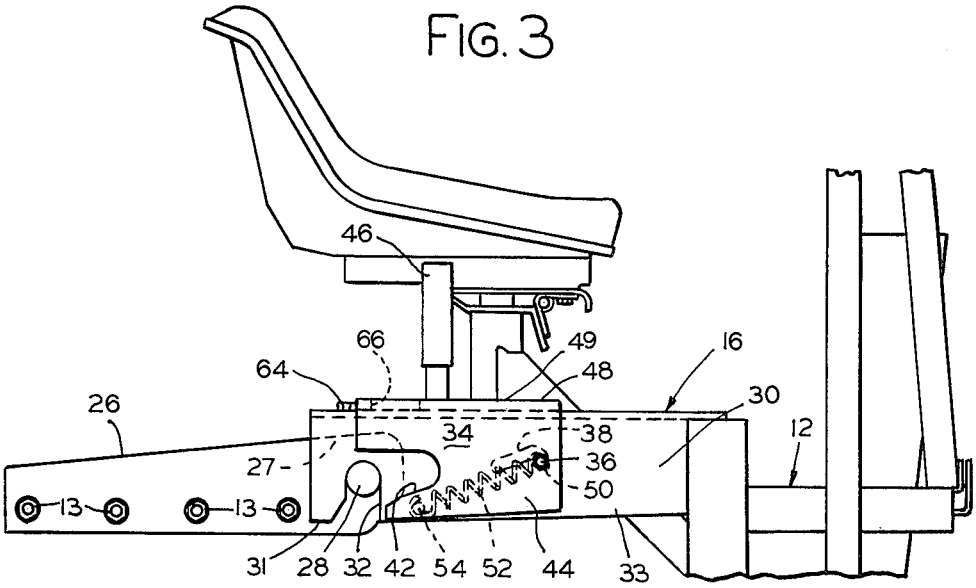
FIG. 3 is a side elevationsl detail view similar to FIG. 2 with the sleeve member shown in its disconnect position.
Figure 4:
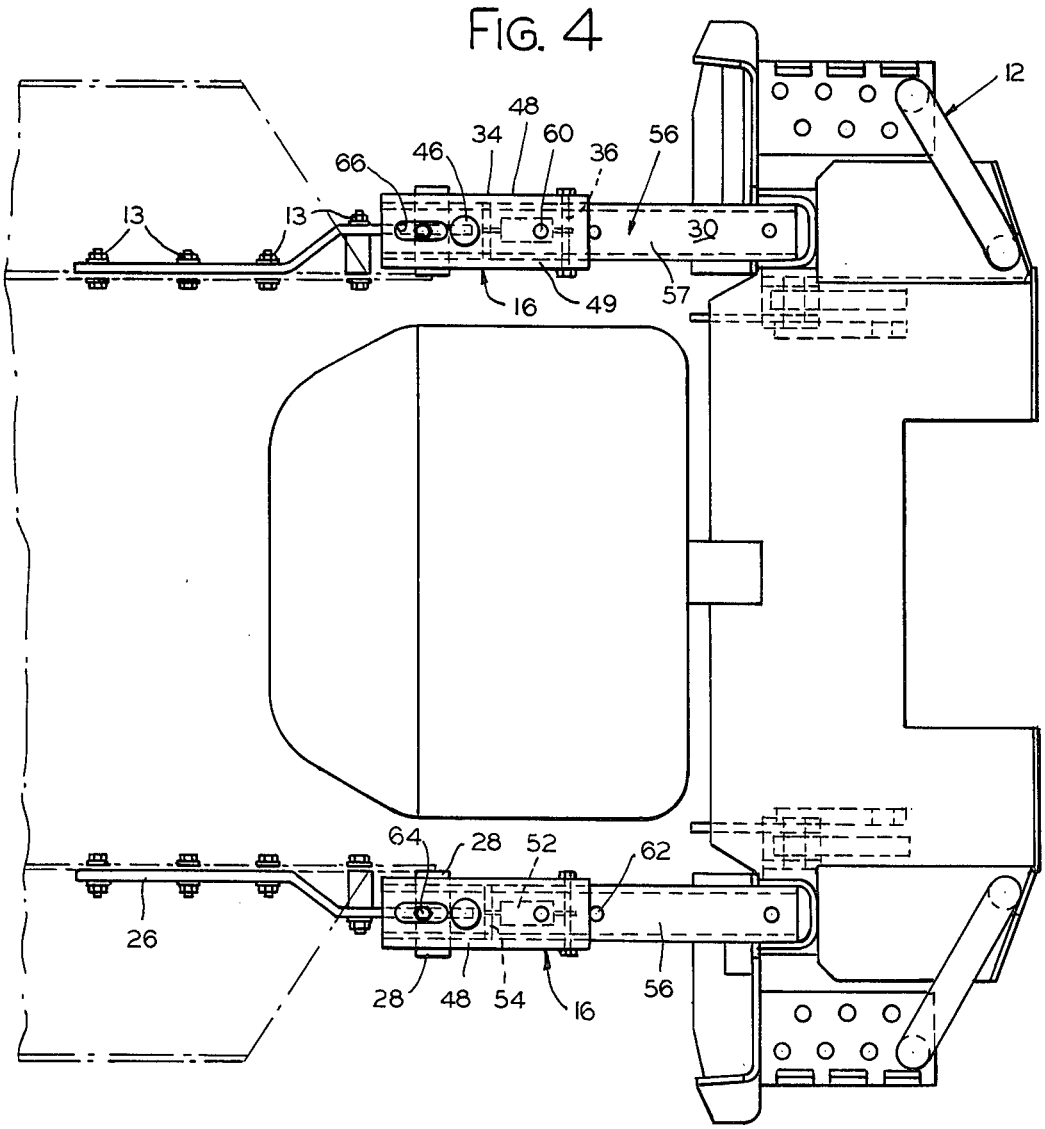
FIG. 4 is a partial plan view of the connection device shown in the FIG. 2 engaged position.

A sleeve member 34 is slidably disposed over and operably connected to the channel element 30 and includes opposed vertical sidewalls 44 and a connecting base 48. As best shown in FIGS. 2 and 3 the outer edge or surface of each sidewall 44 of each sleeve member 34 has a wedge configuration 42 for locking contact with cylindrical bars 28 for retaining the cylindrical bars 28 in engagement with the respective downwardly disposed channel openings 32. Each channel element 30 has an elongated slot 38 in each sidewall 33. The elongated slots 38 in opposed sidewalls 33 are in alignment. A bolt or transverse pin 36 is positioned for travel in the aligned elongated slots 38 and is carried by the sleeve member 34. The sleeve member 34 pivots about the bolt 36. A lever or handle 46 is attached to an outer surface 49 of base 48 for longitudinally positioning the sleeve member 34 on the channel element 30 and for pivoting the sleeve member with respect to the channel element. A rod 54 is inserted through aligned openings in sidewalls 33 of channel element 30 adjacent the outer end 31 of channel element 30 and spaced below the bolt 36. A spring 52 acts between the bolt 36 and rod 54 to bias the sleeve member 34 to the left towards the outer end 31 of channel element 30. Each of the elongated slots 38 has a rightward hook or static portion 50. The sleeve member is held against the leftward bias of the spring 52 when the bolt 36 of the sleeve member 34 is positioned in the hook portion 50 as shown in FIG. 3 and the sleeve member 34 so positioned is prevented from interfering with the engagement and disengagement of the outer element ends 27 and 31.

A projection includes a machine bolt 64 engaged with a nut 65 fixed to the inner surface 58 of base 56. The projection upwardly extends from the outer surface 57 of base 56 and selectively abuts the leading left outer edge of the sleeve member horizontal wall 48 for also retaining the sleeve member 34 in the FIG. 3 disconnect position, i.e., the sleeve member 34 in its FIG. 3 position is prevented by the projection from locking contact with the cylindrical bars 28 received in downwardly disposed openings 32. Optionally provided in the base 48 of sleeve member 34 and the base 56 of channel element 30 are holes or openings 60 and 62, respectively, which are in alignment when the sleeve member is in its FIG. 3 disconnect position. When the holes 60 and 62 are in alignment, a locking pin (not shown) can be inserted therethrough for also retaining the sleeve member in the FIG. 3 disconnect position. The sleeve member base 48 has an elongated longitudinal slot 66 for selectively receiving the projection upon proper positioning of the sleeve member 34 by operator manipulation of the handle 46 from the position shown in FIG. 3 to the position shown in FIG. 2.

OPERATION

The adaptor assembly 18 is first engaged in connecting the loader 10 to the backhoe 14. Initially the loader 10 is driven behind the backhoe mounting frame 12 to a position where the elongate member 20 is positioned below the overhanging member 24. The boom arms 22 are then raised until both the elongate member 20 and overhanging member 24 are in wedging engagement to provide the backhoe with a lower load bearing connection with the loader and the channel elements 30, extending from the rear of the mounting frame 12 are raised above the loader anchor elements 26.

To now engage the pair of spaced apart upper connection devices 16, each sleeve member 34 is in its FIG. 3 disconnect position on respective channel elements 30. The operator then adjusts the position of the loader so that the cylindrical bars 28 are spaced directly below the channel element openings 32 and then lowers the boom arms 22 to place the cylindrical bars 28 in engagement with the openings 32.

To retain the cylindrical bars 28 in respective openings 32, each sleeve member 34 is pivoted away from the channel element 30 and above the machine bolt 64. In the above-described pivoted position, each sleeve member may be longitudinally moved towards the outer end 31 of the channel element 30 and so positioned may be downwardly pivoted to again overlie the channel element wherein an elongated longitudinal slot opening 66 in the sleeve member 34 receives the projection as shown in FIG. 2. In the FIG. 2 position, the wedge configurations 42 formed on the outer edges of sleeve member side walls 44 are in locking contact with the cylindrical bars 28 received in the channel openings 32. A downwardly directed force on sleeve member 34 would tend to rightwardly shift the sleeve member out of locking contact with the cylindrical bars 28 received in the channel openings 32 except that rightward sleeve member movement is limited by the length of the elongated sleeve slot 66 when the sleeve member is in its FIG. 2 position due to projection-sleeve slot contact. The above control of sleeve member movement is a safety feature and insures locking contact between the wedge configuration 42 on sidewalls 44 of sleeve member 34 and cylindrical bars 28 when the connection device is in its FIG. 2 position.

To disconnect the loader 10 from the backhoe 14 the above-discussed process is reversed where the operator initially moves each of the sleeve members 34 from their FIG. 2 position to their FIG. 3 position and then reverses the boom arm and loader movement steps previously described during the attachment process.

From the foregoing it is believed that those familiar with the art will readily recognize and appreciate the novel concepts and features of the present invention. Obviously while the invention has been described in relation to only one preferred embodiment, numerous variations, changes, and substitutions of equivalents will present themselves to persons skilled in the art and may be made without necessarily departing from the scope and principles of this invention. For example, although the connection devices shown herein are used between a backhoe and a skid steer loader, persons skilled in the art would recognize that other types of accessory apparatus and or traction vehicles may be connected by means of the present invention without departing from the spirit of the invention and the scope of the claims herein. As a result, the embodiment described herein is subject to various modifications, changes and the like with the scope of this invention being determined solely by reference to the claims appended hereto.

What is claimed is:

1. A device for connecting accessory apparatus to a traction vehicle including:

a first element including a first element end extending from said traction vehicle towards said apparatus and a channel element having opposed walls and wherein each of said opposed walls has a slot;

a second element including a second element end extending from said apparatus towards said traction vehicle;

said element ends having a selectively engaged position for connecting said apparatus to said traction vehicle;

a sleeve member slidably disposed over and operatively connected to one of said elements for movement thereon, said sleeve member having a surface adapted for selective locking contact with at least one of said element ends for retaining said element ends in said engaged position; and a transverse pin carried by said sleeve member and positioned for travel in said slots.

2. A device for connecting accessory apparatus to a traction vehicle including:

a first element including a first element end extending from said traction vehicle towards said apparatus;

a second element including a second element end extending from said apparatus towards said traction vehicle;

said element ends having a selectively engaged position for connecting said apparatus and said traction vehicle;

said element end of one of said elements including at least one transverse member;

said other element including an open channel element having opposed walls, an opening in at least one of said walls to receive said transverse member and slots in each of said walls of said channel element;

said transverse member received in said channel opening when said element ends are in said engaged position;

a sleeve member slidably disposed over and operatively connected to said channel element for movement thereon, said sleeve member having a surface adapted for selective locking contact with at least one of said element ends for retaining said element ends in said engaged position; and a transverse pin carried by said sleeve member and positioned for travel in said slots.

3. The connection device as claimed in claim 1 or 2 further including a projection extending from said channel member, and wherein said sleeve member is pivotable about said transverse pin and has an elongated opening for selectively receiving said projection, and wherein the extent of said sleeve member movement is limited by the length of said elongated opening when said projection is received in said opening, whereby said sleeve member is prevented from movement on said channel element sufficient to cease said locking contact with at least one of said element ends.

4. The connection device as claimed in claim 3 wherein said projection selectively prevents said sleeve member from said selective locking contact with at least one of said element ends, whereby said element ends can be engaged and disengaged without interference from said sleeve member.

5. The connection device as claimed in claim 1 or 2 further including a bias member acting between said transverse pin and said channel element for urging said sleeve member towards said element end of said channel element.

6. The connection device as claimed in claim 5 further including a lever connected with said sleeve member for positioning said sleeve member with respect to said channel element, and further wherein said slots in said walls of said channel element each have a static portion and when said lever is actuated to slide said sleeve member so that said rod is positioned in said static portion said bias member is prevented from urging said sleeve member towards said element ends, whereby said element ends can be engaged and disengaged without interference from said sleeve member.

7. The device as claimed in claim 1 or 2 further comprising means operatively connected with said sleeve member for selectively preventing movement towards said element ends whereby said element ends can be engaged and disengaged without interference from said sleeve member.

8. The connection device as claimed in claim 2 wherein said first element includes said transverse member and wherein said second element is said open channel element.

9. The connection device as claimed in claim 1 or 2 wherein said sleeve member surface includes a wedge configuration.

10. A pair of spaced apart opposed connection devices of claim 1 or 2 wherein said accessory apparatus is a backhoe.

* * * * *